United States Patent [19]

Johne et al.

[11] 4,408,528

[45] Oct. 11, 1983

[54] PRINTING EQUIPMENT WITH SCREW CONTROLLED DOCTOR BLADE

[75] Inventors: Hans Johne, Radebeul; Karl-Heinz Förster, Dresden; Arndt Jentzsch; Wolfgang Müller, both of Coswig, all of German Democratic Rep.

[73] Assignee: VEB Kombinat Polygraph "Werner Lamberz" Leipzig, Leipzig, German Democratic Rep.

[21] Appl. No.: 245,672

[22] Filed: Mar. 19, 1981

[30] Foreign Application Priority Data

Apr. 10, 1980 [DD] German Democratic Rep. ... 220343

[51] Int. Cl.[3] ..... B41F 31/02

[52] U.S. Cl. ..... 101/364

[58] Field of Search ..... 101/363, 364, 365, 366, 101/367, 157, 167, 169, 350, 148

[56] References Cited

U.S. PATENT DOCUMENTS 3,779,165 12/1973 Abendroth et al. ..... 101/365

4,242,958 1/1981 Jeschke ..... 101/363

FOREIGN PATENT DOCUMENTS 2007594 5/1979 United Kingdom ..... 101/365

*Primary Examiner*—E. H. Eickholt

*Attorney, Agent, or Firm*—Michael J. Striker

[57] ABSTRACT

A ductor roller and a doctor blade together define an inking gap in a printing machine. One or more ink-control screws can press against the doctor blade to locally reduce the width of the gap. Each screw carries an abutment arrangement which is engageable with respective opposite sides of the machine's ink trough, depending upon the direction of rotation of the screw, so as to define two specific end positions for the screw and thus a maximum and a minimum width of the ink gap.

5 Claims, 3 Drawing Figures

PRINTING EQUIPMENT WITH SCREW CONTROLLED DOCTOR BLADE

BACKGROUND OF THE INVENTION

This invention relates generally to printing equipment.

More particularly, the invention relates to equipment for adjusting the gap between the ductor roller and the associated doctor blade of the ink supply system in a printing machine.

The purpose of the doctor blade is to strip excess ink off the surface of the ductor or ink pickup roller. To control the rpint quality it is necessary to be able to control the thickness of the ink film which remains on the roller; usually, a uniform thickness of this film over the entire length of the roller is not sufficient. Therefore, the width of the gap between the roller and the doctor blade is made separately adjustable in a plurality of ink zones which are arranged adjacent one another, in direct lengthwise of the roller and blade. The adjustment is effected by exerting pressure upon sections of the doctor blade edge which extends along the gap—and the pressure is applied by socalled ink-control keys (screws) which act upon the doctor blade either directly or via appropriate levers.

It is important to be able to reproduce any particular gap width at any particular point of adjustment—which of course means that the setting of the particular ink-control screw must be similarly reproducible. This is possible only if a well-defined zero position can be achieved for each of the screws, i.e., a position in which the gap is so adjusted that the ink is stripped almost completely off the ductor roller, leaving behind only the thinnest of ink films.

Since there are a great many of these ink-control screws on each machine (where they are not always in readily accessible positions), and since an operator often has to service more than one machine, it is not practicable to have to adjust the screws manually and in film. Remotely controlable ink-control screws have therefore been developed.

One of these has been proposed in GDR patent DL-PS No. 139,114. It has an axial abutment which is clamped onto the shaft of the screw and which, when it engages a cooperating counter-abutment, limits the extent to which the screw can move in the sense of reducing the width of the gap between doctor blade and ductor roller. To be able to effect gap adjustments with the desired accuracy, ink-control screws have threads with only a small pitch. In the context of this prior-art arrangement this small pitch is a disadvantage, because the engagement of the two abutments with one another—and the small pitch of the thread—produce a high force in axial direction of the screw which results in seizing of the thread and prevents, or at least hinders, subsequent backing-off of the screw. A reproducability of the setting—and of the ink-film thickness—is thereby prevented, with resultant misprints and machine downtime.

There are other advantages associated with prior-art remote-controlled ink screws. For example, to effect zero-setting adjustments of such screws it is necessary to advance the screws (and close the gap) until no ink at all is allowed onto the surface of the ductor roller. Such an adjustment is not reproducible. Moreover, it may result in damage to the doctor blade and/or the ductor roller, and is in any case inaccurate because it may result in flexing of the ductor roller.

Also, the prior art permits the screws to be adjusted only in the sense causing the gap between the blade and the roller to become narrower. However, it is often necessary to increase the gap width, rather than reduce it, and in that event the prior-art teaching is not useable.

SUMMARY OF THE INVENTION

Accordingly, it is a general object of the invention to overcome prior-art disadvantages.

A more particular object is to provide an improved arrangement of the type under discussion, in which a remotely adjustable ink-control screw permits optimum inking of material being printed, using simple instrumentalities and uncomplicated technology.

Still a further object is to provide such an arrangement which does not lead to damage of the doctor blade and/or the ductor roller.

A concomitant object is to provide an arrangement of the kind in question which permits exact zero-setting adjustment relative to the ductor roller.

Yet an additional object is to provide such an arrangement with an ink-control screw which cannot become blocked by seizing of its thread, and which is also provided with an abutment for setting of the maximum gap width between doctor blade and ductor roller.

Pursuant to these objects and still others which will become apparent hereafter, one feature of the invention resides in an arrangement of the character described. Briefly stated, such an arrangement may comprise at least one ink-control screw operatively engaged with the marginal portion of the doctor blade and movable forwards and backwards to effect varying deflection of the marginal portion and thus change the width of the inking gap; and abutment means projecting radially from the screw and engageable with opposite sides of a stationary part of the arrangement, depending upon the direction of rotation of the screw, so as to define two end positions for the screw and hence a maximum and a minimum width for the inking gap.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
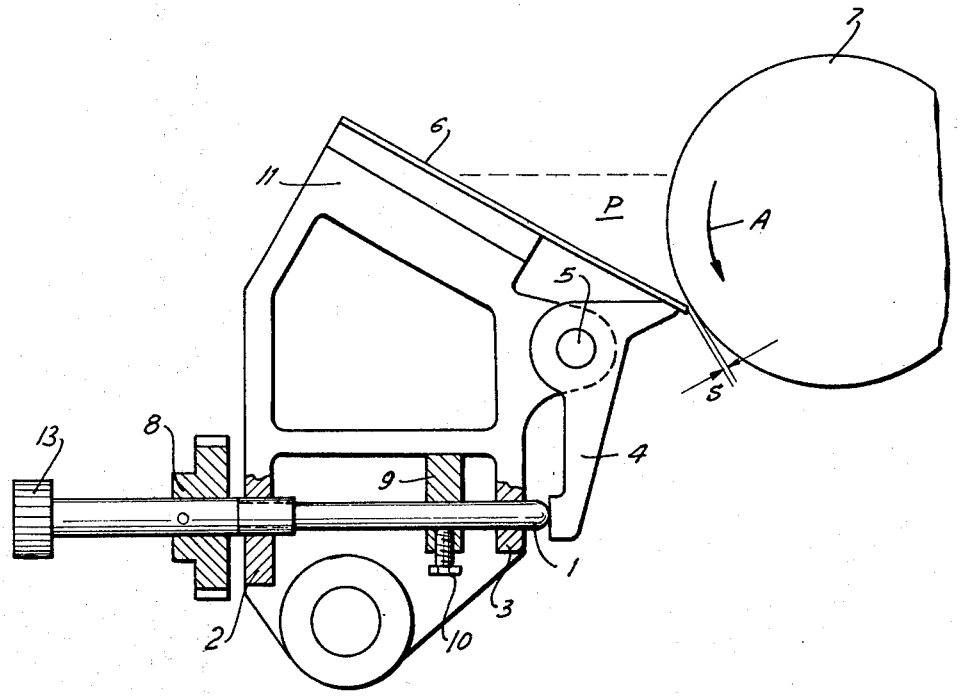
FIG. 1 is a somewhat diagrammatic side view, partly in section, of an arrangement embodying the invention.
Figure 2:
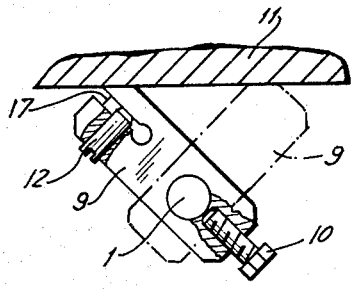
FIG. 2 is a detail view, on an enlarged scale, showing a part of the embodiment in FIG. 1.

A first embodiment of the invention is illustrated in FIGS. 1–2 wherein reference numeral 7 identifies a rotatable ductor roller and reference numeral 6 a doctor blade which extends along the roller 7 and has a free edge which defines with the roller surface an ink gap S. In operation an ink pool P of generally wedge-shaped cross-section is maintained in the space included between blade 6 and roller 7; as the latter rotates in the direction of arrow A it entrains ink from pool P in form of a surface layer, the thickness of which depends upon the width of the gap S.

Blade 6 is mounted on the ink box or housing 11 which also extends lengthwise (axially) of roller 7 and carries, beneath the forward edge of blade 6, a plurality (only one shown) of double-armed levers 4 each which is pivoted at 5. A corresponding plurality of ink-control screws 1 is provided (one shown); each of these is threaded into a holder 2 (may be integral or of one piece with housing 11) and extends freely slidably through a bore of a bearing support 3 (may be integral or of one piece with housing 11). Rearwardly of holder 2 each screw 1 carries a gear 8 which can turn with but not relative to it. A knurled knob 13 is shown which permits manual turning of the screw 1; in actual fact, however, a remote adjustment control will be provided (known per se and therefore not specifically illustrated) which permits the screw to be advanced or backed off as a result of remote command signals which are issued, for example, from a machine control stand and transmit motion to screw 1 via the gear 8.

In any case, advancement of the screw 1 causes its leading end to press against one arm of the associated lever 4, causing the lever to pivot about pivot 5 and the other arm to press against the underside of doctor blade 6. This reduces the width of the gap S.

In accordance with the invention the screw 1 has mounted on it an abutment 9 which is secured to it by one or more screws 10 (one shown) and extends radially from screw 1. Abutment 9 is fixedly connected with the screw 1 and is eccentric thereto. In the two permissible end positions of screw 1 the abutment 9 engages the housing 11 so as to permit further turning of the screw 1 in one or in the opposite direction. The one abutment side of member 9—in direction towards the ductor—has a slot 17 and can be fine-adjusted via a pressure-exerting screw 12; the other abutment side—away from the ductor—is shown in broken lines in FIG. 2.

With the abutment 9 it is a simple matter to preselect the maximum and minimum permissible width of the gap S, simply by choosing the angular orientation at which the abutment 9 is clamped to the screw 1. The screw 1 can be turned through an angle of 270° in this embodiment; since no axial forces develop to act on screw 1, the threads thereof cannot seize and block the screw.

To operate the arrangement the screws 1 are advanced (manually or via gears 8) until the width of gap S is so small that no ink can pass through the gap. Now the abutment 9 is released by backing off the screw 10 and rotated until its resilient side (the one having the slot 17 which imparts this resilience) abuts against the housing 11. The screw 10 is then tightened and a fine adjustment made via screw 12. Subsequently the screws 1 are backed off until the gap S has reached a width at which the ink film on ductor roller 7 exhibits optimum thickness.

Figure 3:
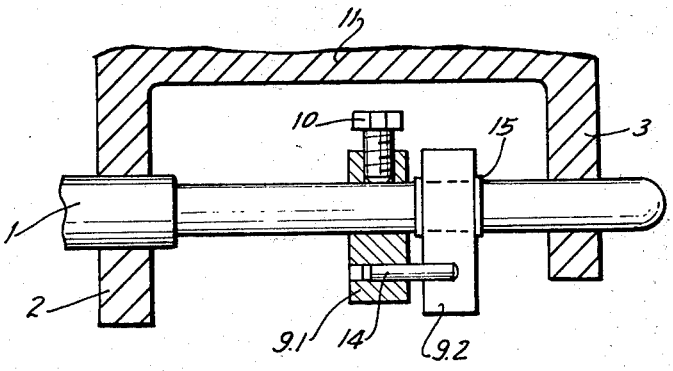
FIG. 3 is a detail view, on an enlarged scale and partly in section, of another embodiment of the invention.

The embodiment of FIG. 3 is identical with that of FIG. 1 in all not-illustrated particular. It differs only in respect of the details shown in FIG. 3.

Specifically, the embodiment of FIG. 3 replaces the single abutment 9 with two abutments, a fixed abutment 9.1 and a loose abutment 9.2. Again, screw 10 is used to firmly mount the fixed abutment 9.1 on the shaft of screw 1. A pin 14 is mounted in or on the abutment 9.1 and projects from it axially of the screw 1. Axially adjacent of fixed abutment 9.1 the screw carries the loosely turnable eccentrically mounted abutment 9.2 which is, however, prevented by circlips 15 or similar elements from shifting axially of the screw 1. The free end of pin 14 axially overlaps the abutment 9.2, as shown.

With this arrangement the screw 1 can be turned through and in excess of 360° of arc, since the pin 14 simply takes the abutment 9.2 along during rotation of the screw 1, until the abutment 9.2 engages the housing 11 (this is why it is eccentrically mounted, i.e., to permit such engagement). In fact, if several of the loose abutments 9.2 are provided axially adjacent one another, and if all but the last one (the one farthest from abutment 9.1) are provided with pins corresponding to the pin 14, then the screw can be turned through an unlimited (but selectable) angular range.

The invention permits both permissible end positions for the screw 1 (i.e., maximum and minimum gap width) to be reliably selected and maintained, without any danger that the screw might become blocked. Operating errors and damage to doctor blade and/or ductor roller, are precluded. Because the invention uses abutments which act in circumferential direction of the screw 1, zero settings for all ink-control screws located over the entire length of roller 7 is a simple matter and reproducible whenever desired.

While the invention has been illustrated and described as embodied in an ink-control screw for an ink supply arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a printing-machine inking arrangement having a stationary part, a ductor roller and a doctor blade a marginal portion of which defines with the roller an inking gap, a combination comprising at least one ink-control screw operatively engageable with the marginal portion of the doctor blade and movable forwards and backwards along its axis to effect varying deflection of the marginal portion and thus change the width of the inking gap; elongated abutment means projecting radially from said screw and engageable at opposite sides thereof with the stationary part of the arrangement, depending upon the direction of rotation of the screw, so as to define two end positions for the axial movement of the screw and hence a maximum and a minimum width for the inking gap, said abutment means comprising an alongated abutment member which is removably mounted on said screw and having a free end portion for engagement with said stationary part, and said free end portion having a side which is leading when said screw turns in a sense causing it to advance and to reduce the width of said gap, said free end portion being formed with a slit extending lengthwise of the elongation of said abutment member parallel to said side and subdividing said free end portion into two parallel tongues spaced by said slit; and further comprising means for resiliently displacing one of said tongues transversely of said slit relative to the other of said tongues.

2. A combination as defined in claim 1, said last-mentioned means being a pressure screw mounted in said other tongue and having a free end which bears upon said one tongue.

3. In a printing-machine inking arrangement having a stationary part, a ductor roller and a doctor blade a marginal portion of which defines with the roller an inking gap, a combination comprising at least one ink-control screw operatively engageable with the marginal portion of the doctor blade and movable forwards and backwards along its axis to effect varying deflection of the marginal portion and thus change the width of the inking gap; elongated abutment means projecting radially from said screw and engageable at opposite sides thereof with the stationary part of the arrangement, depending upon the direction of rotation of the screw, so as to define two end positions for the axial movement of the screw and hance a maximum and a minimum width for the inking gap, said abutment means comprising a fixed abutment member mounted on and turnable with said screw, and a movable abutment member mounted on and at least at times turnable relative to said screw.

4. A combination as defined in claim 3, said fixed abutment member having a radially outer free end portion, and a pin projecting from said end portion.

5. A combination as defined in claim 4, said pin having a portion engageable with said movable abutment member to entrain the same on rotation of said screw and fixed abutment member, until engagement takes place with said stationary part of the arrangement.

* * * * *